US005571780A

United States Patent [19]

Silvani et al.

[11] Patent Number: 5,571,780

[45] Date of Patent: Nov. 5, 1996

[54] PROCESS FOR REDUCING THE BACK MIGRATION IN MECHANICAL VACUUM PUMPS OPERATING WITH PERFLUOROPOLYETHER OILS

[75] Inventors: Rossella Silvani; Valerio Carsetti, both of Milan; Casimiro Pace, Alessandria; Padmanabhan Srinivasan, Milan, all of Italy

[73] Assignee: Ausimont S.p.A., Italy

[21] Appl. No.: 599,661

[22] Filed: Feb. 9, 1996

Related U.S. Application Data

[63] Continuation of Ser. No. 344,514, Nov. 23, 1994, abandoned, which is a continuation of Ser. No. 10,417, Jan. 28, 1993, abandoned.

[30] Foreign Application Priority Data

Jan. 30, 1992 [IT] Italy ..... MI92A0170

[51] Int. Cl.$^6$ ..... C10M 147/04

[52] U.S. Cl. ..... 508/582; 508/588; 508/589; 252/67; 252/69

[58] Field of Search ..... 252/54, 52 A, 252/67, 69; 508/582, 588, 589

[56] References Cited

U.S. PATENT DOCUMENTS

| | | | |
|---|---|---|---|
| 4,178,465 | 12/1979 | Caporiccio et al. | 252/54 |
| 4,451,646 | 5/1984 | Sianesi et al. | 252/54 |
| 5,154,845 | 10/1992 | Williams | 252/54 |
| 5,221,494 | 6/1993 | Ikeda et al. | 252/54 |

FOREIGN PATENT DOCUMENTS 223251 5/1987 European Pat. Off. .

*Primary Examiner*—Prince Willis, Jr.
*Assistant Examiner*—Alan D. Diamond
*Attorney, Agent, or Firm*—Bryan Cave LLP

[57] ABSTRACT

The invention relates to a process for reducing the back migration of the most volatile fractions of perfluoropolyethers during the operation of mechanical vaccum-generating pumps which utilize perfluoropolyethers: use is made of perfluoropolyethers containing not more than 0.1% by weight of fractions having a molecular weight lower than or equal to 1,500 and not more than 1.3% by weight of fractions having a molecular weight lower than or equal to 1,800.

2 Claims, No Drawings

PROCESS FOR REDUCING THE BACK MIGRATION IN MECHANICAL VACUUM PUMPS OPERATING WITH PERFLUOROPOLYETHER OILS

This is a continuation of U.S. application Ser. No. 08/344,514, filed Nov. 23, 1994, now abandoned, which is a continuation of U.S. application Ser. No. 08/010,417, filed Jan. 28, 1993, now abandoned.

The present invention relates to the use of perfluoropolyethers in mechanical vacuum-generating pumps.

In particular, it relates to a process for almost fully eliminating the back migration of the most volatile perfluoropolyether fractions during the operation of the pumps.

The oils utilized in the mechanical vacuum pumps are always composed of mixtures of molecules having a different molecular weight and therefore a different volatility. During the pump operation, the friction among the moving metallic parts causes a heating which gives rise to a certain back migration of the most volatile oil fractions to the chamber in which the vacuum is created. Such fractions can interfere with the treatments which are carried out in said chamber.

In consideration of their very high chemical inertia, the perfluoropolyethers are mainly utilized in the pumps (in particular rotary pumps and roots pumps) for the generation of vacuum in the microelectronics, in dry etching processes and chemical vapour deposition processes.

The perfluoropolyethers, since they are polymeric products, contain fractions of different molecular weight and, therefore, of different volatility, wherefore a certain back migration occurs during their utilization.

The latest technology concerning the semiconductors tends to use more and more advanced processes, in which the presence of little amounts of back migrated perfluoropolyethers, although they are inert, tends to seriously hinder the operations carried out under vacuum.

Thus, the need is felt to have available perfluoropolyethers, which practically do not give rise to back migration.

European patent application No. 223,251 of the Applicant hereof describes the use, in vacuum pumps, of perfluoropolyethers purified from the lightest fractions in order to obtain a higher vacuum and therefore a cleaner residual atmosphere in the vacuum chambers. The utilized perfluoropolyethers have a content of fractions having a molecular weight lower than or equal to 1,000, not exceeding 0.005%.

Such products provide, according to the patent application, a vacuum of at least $5.10^{-4}$ Torr. An excel lent purification from impurities such as Na, K, Cl and Li is obtained.

However, the problem of the back migration is not solved, as is proved in example 5 of the present patent application.

It has now surprisingly been found that the back migration phenomenon is drastically reduced if use is made of perfluoropolyethers containing not more than 0.1% by weight of fractions having a molecular weight lower than or equal to 1,500 and not more than 1.3% of fractions having a molecular weight lower than or equal to 1,800.

Thus, it is an object of the present invention to provide a process which substantially eliminates the back migration of the most volatile perfluoropolyether fractions during the operation of the vacuum pumps.

This and still other objects are achieved by the process—which constitutes the present invention—for reducing the back migration of the most volatile perfluoropolyether fractions during the operation of mechanical vacuum pumps which utilize perfluoropolyethers.

This process is characterized in that use is made of perfluoropolyethers having perfluoroalkyl end groups containing not more than 0.1% by weight of fractions having a molecular weight lower than or equal to 1,500 and not more than 1.3% of fractions having a molecular weight lower than or equal to 1,800.

The molecular weights defined in the present invention are always number molecular weights.

With the process of the present invention, the back migration is usually lower than 10 micrograms/$cm^2$×h.

Preferably, the proportion of fractions having molecular weight lower than or equal to 1,500 is not higher than 0.05%, and the proportion of fractions having molecular weight lower than or equal to 1,800 is not higher than 0.1%: in such conditions, the back migration does not usually exceed 5 micrograms/$cm^2$×h.

The perfluoropolyethers having perfluoroalkyl end groups which are utilized in the present invention can be prepared starting from the corresponding known perfluoropolyethers having a viscosity generally ranging from 100 to 220 cSt at 20° C.

The perfluoropolyethers having perfluoroalkyl end groups, i.e. free from functional groups, are described, as well as their method of preparation, in several documents, among which are British patent 1,104,482, U.S. Pat. Nos. 3,242,218; 3,665,041, 3,715,378; 4,523,039; European patent applications 148,482, 151,877 and 191,490, and International patent applications WO 87/00538 and WO 87/02992.

Various perfluoropolyethers having perfluoroalkyl end groups are available on the market under the trademarks Fomblin(R), Krytox(R) and Demnum(R).

The above said known perfluoropolyethers are subjected to short path distillation so as to obtain the desired reduction degree of the fractions having a molecular weight lower than or equal to 1,500 and 1,800, respectively. To this purpose, the perfluoropolyether film which flows on the heated wall is brought to temperatures generally ranging from 220° to 310° C., while the residual vacuum is generally lower than $5.10^{-3}$ millibars.

Among the perfluoropolyethers suitable for the present invention, there are to be cited the ones indicated hereinbelow, which are treated in such manner as to have a content of fractions exhibiting a molecular weight lower than or equal to 1,500 not exceeding 0.1% by weight, and a content of fractions exhibiting a molecular weight lower than or equal to 1,800 not exceeding 1.3%, and which are endowed, in relation to the type of pump utilized, with a viscosity generally ranging from about 140 to about 270 cSt at 20° C.:

(A)

$$R_f-O-(\underset{\underset{CF_3}{|}}{CF}-CFO)_a(\underset{\underset{CF_3}{|}}{CF}-O)_b(CF_2O)_c-R'_f \qquad (I)$$

where: $R_f$ and $R'_f$, like or different from each other, are selected from the group consisting of $CF_3$, $C_2F_5$ and $C_3F_7$; units $$\underset{\underset{CF_3}{|}}{CF}-CFO,\ \underset{\underset{CF_3}{|}}{CF}-O,\ CF_2-O$$

are statistically distributed along the chain;

a is an integer;

b and c are integers or zero;

when the sum (b+c) is different from zero, the $$\frac{a}{b+c}$$

ratio has a minimum value of at least 5 and a maximum value equal to or higher than 1,000.

(B)

$$CF_3O-(CF_2-\underset{\underset{CF_3}{|}}{C}FO)_f(C_2F_4O)_g-(CFXO)_h-CF_3 \quad \text{(II)}$$

where units $$CF_2-\underset{\underset{CF_3}{|}}{C}FO,\ C_2F_4O,\ CFXO$$

are statistically distributed along the chain;

X is F or $CF_3$;

f, g and h are integers;

the $$\frac{f}{g+h}$$

ratio varies from 1 to 50, and the g/h ratio varies from 1 to 10;

$$\text{(C)}\ R_f^3O-(CF_2CF_2CF_2O)_jR_f^4 \quad \text{(III)}$$

where $R_f^3$ and $R_f^4$, like or different from each other, are $-CF_3$ or $-C_2F_5$ and j is an integer.

Particularly preferred are the perfluoropolyethers corresponding to the following formulas:

$$CF_3-(O\underset{\underset{CF_3}{|}}{C}F-CF_2)_m(OCF_2)_n-OCF_3 \quad \text{(IV)}$$

in which m/n is equal to or higher than 1,000 and $$F-(CF_2-\underset{\underset{CF_3}{|}}{C}FO)_q-CF_2-CF_3 \quad \text{(V)}$$

The following examples are merely illustrative and are not to be considered as a limitation of the scope of the present invention.

EXAMPLE 1

A perfluoropolyether conforming to the present invention was prepared starting from a perfluoropolyether commercially known as Fomblin Y 14/6 corresponding to formula (IV), in which the m/n ratio is equal to about 1,000 and which exhibits a viscosity equal to 140 cSt at 20° C.

It was subjected to short path distillation so as to obtain a content of fractions having a molecular weight equal to or lower than 1,500 equal to 0.04% and a content of fractions having a molecular weight equal to or lower than 1,800 equal to 0.1%. To this purpose, the perfluoropolyether film flowing on the heated wall had a temperature of about 260° C., while the residual vacuum was lower than $5.10^{-3}$ millibars.

The product so obtained had a viscosity of 210 cSt at 20° C.

Use was made of a rotary pump of type 2012 CP manufactured by CIT ALCATEL.

In order to measure the back migration, a little stainless steel disc having a diameter of 41 mm, cooled with water, was introduced into the pump mouth.

The pump was made to run for 4 hours.

The back migration rate was measured at the end of the test as follows:

- BMR (back migration rate)=$(W_2-W_1)/S\times t$, in which:
  - $W_1$ is the weight, in micrograms, of the clean disc introduced before the begin of the test;
  - $W_2$ is the weight, in micrograms, of the disc coated with the back migration products;
  - S is the disc surface exposed to the back migration products, expressed in $cm^2$;
  - t is the time, expressed in hours.

On conclusion of the test, the last total pressure was measured in Torr.

The results were as follows:

- BMR 5 $\mu g/cm^2\times h$
- Final total pressure $1.5\cdot10^{-3}$ Torr.

The test was repeated three times, obtaining the same results.

The back migration products collected on the stainless discs were analyzed by means of gel permeation chromatography: it was possible to ascertain that the perfluoropolyether molecules had not undergone any thermal degradation.

EXAMPLE 2 (COMPARATIVE)

After the pump had been accurately cleaned with a $CCl_2F$-$CClF_2$ flow (solvent for perfluoropolyetyers), the test of example 1 was repeated, but using a product not conforming to the present invention, having the following characteristics:

- commercial perfluoropolyether Fomblin Y 25/6 corresponding to formula (IV)
- viscosity equal to 270 cSt at 20° C.

% by weight of fractions having a molecular weight lower than or equal to 1,500: 1.0%; % by weight of fractions having a molecular weight lower than or equal to 1,800: 3.4%.

The results were as follows:

- BMR 67 $\mu g/cm^2\times h$
- Final total pressure $2\cdot10^{-3}$ Torr.

EXAMPLE 3

A perfluoropolyether conforming to the present invention, identical with the one of example 1, was utilized in a rotary pump, type E2 M8, manufactured by EDWARDS.

By operating according to example 1, the following results were obtained, which are identical with the ones of said example:

- BMR 5 $\mu g/cm^2\times h$
- Final total pressure $1.5\cdot10^{-3}$ Torr.

EXAMPLE 4 (COMPARATIVE)

In the same pump of example 3, previously subjected to a thorough cleaning as is described in example 2, there was utilized a product not conforming to the present invention and having the following characteristics::

- commercial perfluoropolyether Fomblin Y 06/6 corresponding to formula (IV)
- viscosity=60 cSt at 20° C.

- % by weight of fractions having a molecular weight lower than or equal to 1,500: 7%; % by weight of fractions having a molecular weight lower than or equal to 1,800: 52.3%.

The test was conducted according to the modalities of example 1.

The following results were obtained:

- BMR 143 $\mu g/cm^2 \times h$
- Final total pressure $2.3 \cdot 10^{-3}$ Torr.

EXAMPLE 5 (COMPARATIVE)

In the same pump of example 1, previously subjected to a thorough cleaning as is described in example 2, there was utilized a product conforming to the cited European patent application 223,251 .

The product exhibited the following characteristics:

- perfluoropolyether corresponding to formula (IV)
- viscosity: 270 cSt
- % by weight of components having an average molecular weight lower than 1,000: 0.005%.

The test was carried out according to the same modalities of example 1.

The following results were obtained:

- BMR 140 $\mu g/cm^2 \times h$
- Final total pressure $4.10^{-4}$ Torr.

We claim:

1. A process for generating vacuum comprising operating a mechanical vacuum pump containing perfluoropolyethers having perfluoroalkyl end groups, said perfluoropolyethers having a perfluoropolyether fraction such that the amount of perfluoropolyether having a molecular weight lower than or equal to 1,500 is present in an amount not exceeding 0.1% by weight of said perfluoropolyethers, and the amount of perfluoropolyether having a molecular weight lower than or equal to 1,800 is present in an amount not exceeding 1.3% by weight of said perfluoropolyethers.

2. The process of claim 1, wherein the amount of perfluoropolyether having a molecular weight lower than or equal to 1,500 is present in an amount not exceeding 0.05 % by weight, and the amount of perfluoropolyether having a molecular weight lower than or equal to 1,800 is present in an amount not exceeding 0.1% by weight.

* * * * *